United States Patent [19]

Ozawa et al.

[11] 4,404,900

[45] Sep. 20, 1983

[54] APPARATUS FOR MULTIPLE COLOR PRINTING OF ARTICLES WITH TAPERED SURFACES

[75] Inventors: Kazumi Ozawa, Koga; Shinichiro No, Hooya, both of Japan

[73] Assignee: Kabushiki Kaisha Yakult Honsha, Tokyo, Japan

[21] Appl. No.: 239,122

[22] Filed: Feb. 27, 1981

[30] Foreign Application Priority Data

Feb. 28, 1980 [JP] Japan ..... 55-24365

[51] Int. Cl.[3] ..... B41F 17/20

[52] U.S. Cl. ..... 101/40; 198/479; 198/480

[58] Field of Search ..... 101/38 A, 38 R, 39, 101/40; 198/478–480

[56] References Cited

U.S. PATENT DOCUMENTS

| | | | |
|---|---|---|---|
| 2,206,686 | 7/1940 | Bauman | 101/38 A X |
| 3,512,478 | 5/1970 | Rose | 101/38 R |
| 3,521,298 | 7/1970 | Morel et al. | 101/40 |
| 3,548,745 | 12/1970 | Sirvet et al. | 101/40 |
| 3,640,213 | 2/1972 | Schwartzbach | 101/8 |
| 3,645,201 | 2/1972 | Jackson | 101/248 X |

*Primary Examiner*—Clifford D. Crowder

*Attorney, Agent, or Firm*—Birch, Stewart, Kolasch & Birch

[57] ABSTRACT

A continuous multicolor printing apparatus for forming stepwise clear multicolor images on the tapered surfaces of conical or truncated conical articles which are successively fed thereto and conveyed by a conveyor unit at a constant speed.

4 Claims, 8 Drawing Figures

APPARATUS FOR MULTIPLE COLOR PRINTING OF ARTICLES WITH TAPERED SURFACES

BACKGROUND AND OBJECTS OF THE INVENTION

This invention relates to an apparatus for printing stepwise in multicolour the tapered surfaces of conical or truncated-conical articles which are successively fed and conveyed by a conveyor unit at a constant speed.

This invention has for its object to provide a continuous multicolour printing apparatus for forming stepwise clear multicolour images on the tapered surfaces of conical or truncated conical articles which are successively fed thereto and conveyed by a conveyor unit at a constant speed.

We have invented earlier a continuous multicolour printing apparatus for printing stepwise in multicolour the surfaces of cylindrical articles which are successively supplied and then conveyed by a conveyor unit at a constanst speed. Japanese Patent Application No. 115245/SHO 54 (1979)]. This invention has been developed for the purpose of rendering the earlier multicolour printing apparatus applicable to conical or truncated conical articles.

Stating in brief, this invention provides a continuous multicolour printing apparatus having very excellent characteristics in that it can effect printing with high accuracy and provide an excellent continuous processing performance and requires a very limited space to install. Such printing apparatus is very useful in particular for continuous flow or line systems at factories.

Other objects and advantages of this invention will become apparent from the following description and claims as illustrated in the accompanying drawings which, by way of illustration only, show preferred embodiments of the present invention and the principle of operation thereof. It is to be understood that the scope of the invention is not to be limited thereto, but is to be determined by the scope of the appended claims.

DETAILED DESCRIPTION OF THE INVENTION

Figure 1:
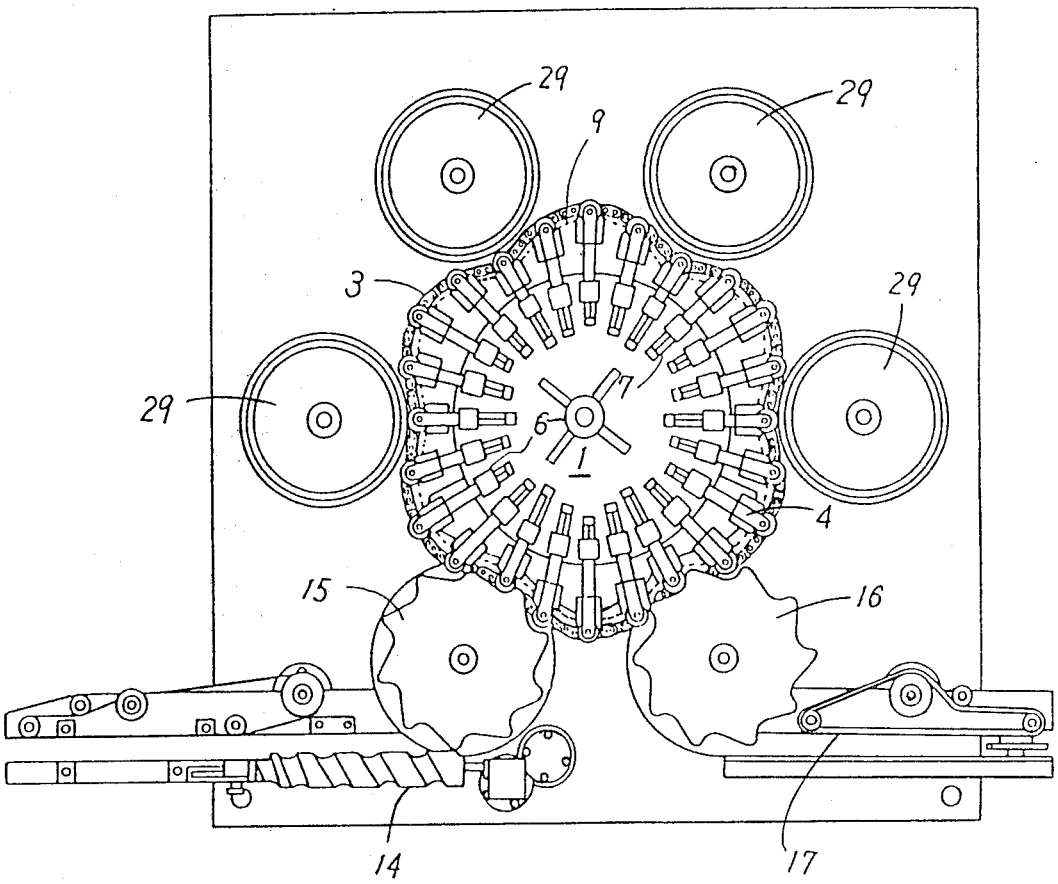
FIG. 1 is an overall plan view of a multicolour printing apparatus according to the present invention incorporating a unit for feeding articles to be printed, a unit for delivering printed articles and transfer drums of a rotary printing unit.

The present invention will now be described in detail hereinbelow.

The present invention provides a continuous multicolour printing apparatus for printing stepwise in multicolour the tapered surfaces of conical or truncated conical articles which are successively fed and conveyed at a constant speed, characterized by that the apparatus comprises (A) a conveyor unit adapted to convey articles to be printed at a constant speed which includes a rotary disk 1 having a plurality of bearings 2 mounted on the outer periphery thereof and having a rotating shaft 11 for rotating the disk, a conveyor chain 3 arranged to be moved along a predetermined conveying locus or path controlled by a guide, a plurality of tilting support means 4 each adapted to support an article to be printed, a sprocket(s) 5 having a shaft 22 driven by a prime mover and adapted to drive said conveyor chain 3, freely rotatable shafts 6 each being mounted in one of said bearings 2, said support means 4 each having an arm 7 adapted to be slidably fitted in one of said shafts 6, said support means 4 each being inclined by an angle corresponding to the degree of taper of the articles to be printed, a rotation or power transmission shaft A and a cradle 12, said conveyor chain 3 being connected through a linkage with said power transmission shaft A, said rotating shaft 11 of the rotary disk 1 being arranged to rotate in synchronism with the rotation of said shaft 22 of the sprocket 5, (B) cradle rotating units each including a fixed plate 8 having a similar configuration to said predetermined conveying locus, a fixed chain 9 stretching around a major part of the outer periphery of said fixed plate 8, a sprocket 10 arranged to rotate the cradle 12, said sprocket 10 meshing with said fixed chain 9 so as to be rotated therealong, and a universal joint 13 arranged to flexibly connect the rotating shaft A of the sprocket 10 and that of the cradle 12, (C) a plurality of rotary printing units disposed along the conveying locus or path of the articles to be printed, (D) a feeding unit for supplying articles to be printed to said conveyor unit, and (E) a delivery unit for delivering printed articles from the apparatus, and that all the rotating means of said units set forth in (A) to (E) above are arranged to rotate in synchronism with one another.

Figure 2:
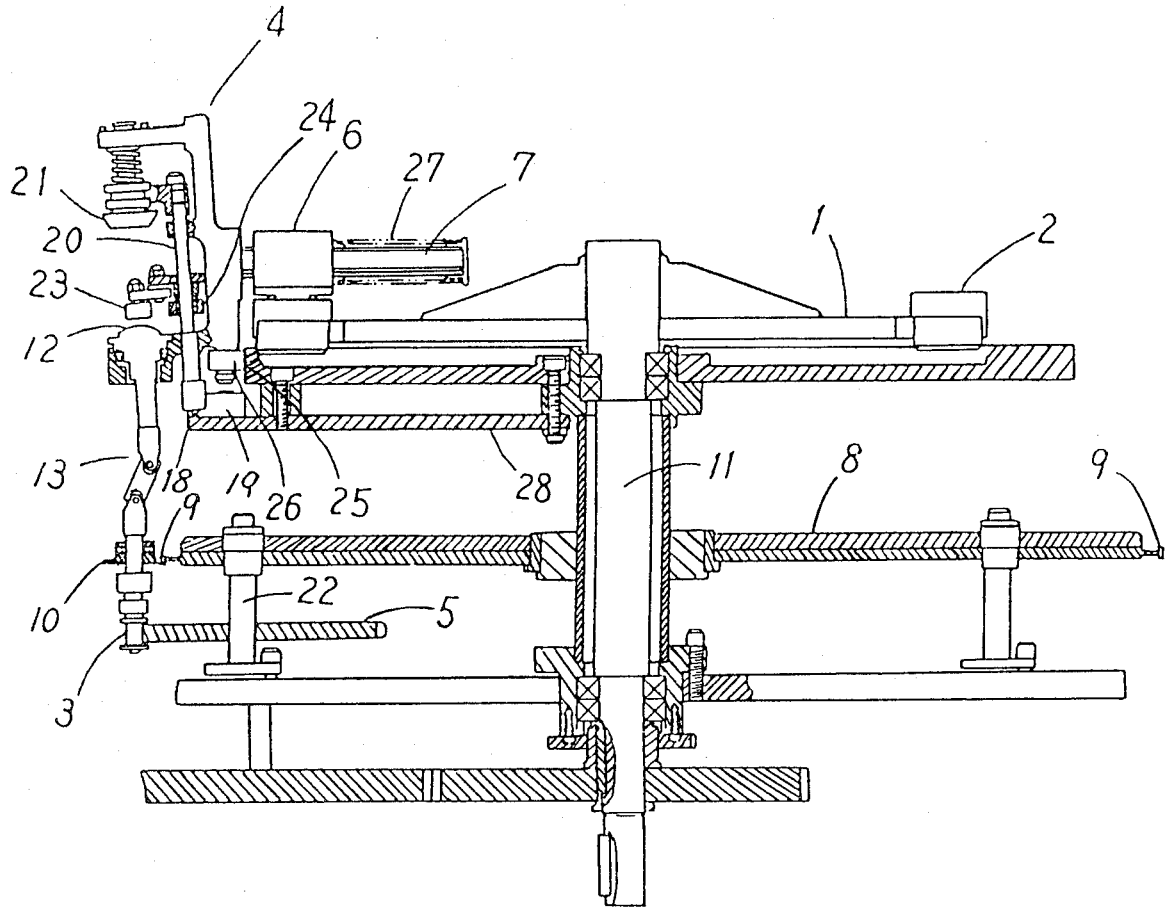
FIG. 2 is a fragmentary sectional view for explaining a constant-speed conveyor unit and a crade rotating unit.
Figure 3:
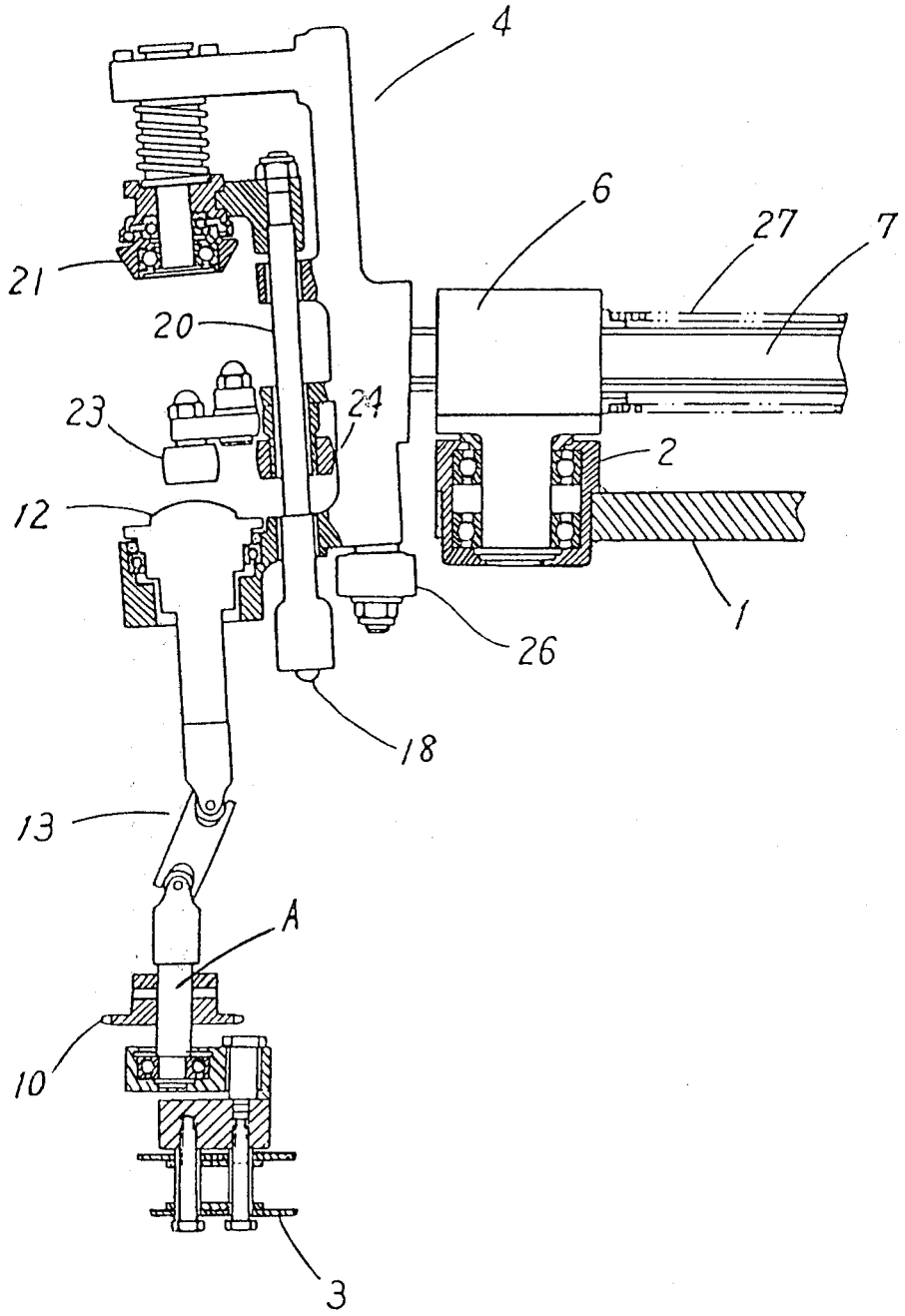
FIG. 3 is a fragmentary sectional view for explaining the cradle rotating unit and means for supporting an article to be printed.

The constant-speed conveyor unit set forth in (A) above forming a first characteristic feature of the present invention can successively convey articles to be printed at a constant speed. Stated in brief, in the constant-speed conveyor unit set forth in (A) above and shown in FIGS. 1 and 2, the arrangement is made such that the load of each article to be printed is carried through the bearing 2 by the rotary disk 1 and the articles can be moved at a constant speed not along the locus of movements of the bearings 2, but along the locus of movement of the conveyor chain 3. Stating in more detail, the loadings of the articles are supported by the bearings 2 each of which is allowed to make circular motion by the rotation of the rotary disk 1. Whilst, the shaft A for transmitting the rotation of the cradle 12 of each article support means 4 is connected with the conveyor chain 3 by means of a linkage as shown in FIG. 3. The conveyor chain 3 is arranged to be driven by the rotating shaft 22 of the sprocket 10 adapted to be rotated in synchronism with the rotating shaft 11 of the rotary disk 1, as already mentioned. However, the conveyor chain 3 is arranged to be moved along a predetermined conveying locus or path controlled by a guide. Therefore, the article support means 4 connected with the conveyor chain 3 will be moved along the locus of movement of the conveyor chain. In brief, the articles loaded on the support means 4 will basically be moved by the circular motion of the bearings 12, but will be ultimately moved by the conveyor chain 3 (refer to FIG. 2) which moves along a predetermined conveying locus. Irrespective of the fact that the locus drawn by the circular motion of the bearings 12 is different from that of movement of the conveyor chain 3, because of the rotation of the rotating shafts 6 and the sliding movements of the arms 7 of the article support means 4, the support units 4 can be freed from its basic circular motion and instead can be moved along the locus of movement of the conveyor chain 3 when the latter is moved.

In short, the articles to be printed will basically be moved along the locus of circular motion drawn by the bearings 12 when they are conveyed by the constant-speed conveyor means set forth in (A), but will ultimately become able to move along a predetermined locus of movement (i.e., the locus of movement of conveyor chain 3). Further, because the connecting portions of the article support means 4 are coupled with the conveyor chain 3 by means of the linkage, the locus of movement of the conveyor chain 3 will be corrected and then transmitted to the articles to be printed. Therefore, the articles to be printed will be able to move more accurately, thereby enabling the accuracy in sequential printing to be improved remarkably.

In the cradle rotating units set forth in (B) above (refer to FIGS. 2 and 3) forming the second characteristic feature of the present invention, the rotation of the cradle rotating sprocket 10 which engages with the fixed chain 9 extending under tension around the fixed plate 8 having a similar shape to the locus of movement of the conveyor chain 3 is transmitted through the universal joint 13 to the cradle 12 of the article support means 4 which is arranged to be inclined by an angle corresponding to the degree of taper of the articles. In that case, by using a sprocket 10 having a diameter which is equal to the average diameter of the tapered article to be printed and by locating the centre of rotation of the circular cross-section of the average diameter on the extension line of the axis of rotation of the sprocket 10, the possible "deviation" of the articles to be printed from a predetermined conveying locus can be minimized.

Consequently, the articles to be printed can be brought into approximate rolling contact with the rotary printing units, such as for example the transfer drums, with a limited slip therebetween, thereby enabling an excellent printing to be achieved. In brief, the tapered outer peripheral surfaces of the articles will be printed by allowing them in rolling contact with a plurality of rotary printing units, such as for example the transfer drums 29, while they are rotated about their axes of rotation with an inclination angle corresponding to the degree of taper of the articles and are simultaneously moved along a predetermined conveying locus or path. During printing, the locus of movement of any one point on the surface of the article will deviate slightly from the predetermined conveying locus because of the inclination of the article. Since every point on the surface being printed is conveyed at the same speed, the deviation from the predetermined conveying locus will cause a difference in conveying speed. Consequently, there will occur a slip between the transfer drums 29 and the circular cross-sections of the articles which are not in synchronism with the circumferential speed of the transfer drums when they are in rolling contact with each other. In other words, because the cradle rotating sprocket 10 will rotate in synchronism with the rotation of the transfer drums 29, a circular cross-section of the article which has a diameter which is equal to that of the sprocket 10 and the centre of rotation of which is located on the extension line of the axis of rotation of the sprocket 10 will be rotated in rolling contact with the transfer drums 29 and in synchronism with the circumferential speed thereof. This means that the other circular cross-sections of the article will not rotate in synchronism with the peripheral speed of the transfer drums 29.

The above-mentioned characteristic arrangement of the present invention can eliminate the occurrence of any problems due to such slip.

In order to ensure that the same regions of the articles to be printed are prepared for printing at the time of commencement of printing of each printing unit, it is necessary to rotate each article to be printed by an integral number of revolutions between the point of commencement of printing of any one of the printing units and that of the next printing unit by setting the number of links of the fixed chain 9 and that of the cradle rotating sprocket 10 at a predetermined value, respectively.

Thus, the articles to be printed can almost be brought into rolling contact with the transfer drums of the rotary printing unit thereby enabling clear printing to be achieved. Furthermore, by positioning the regions of the articles to be printed according to the above-mentioned method, they can be printed in multicolour with high accuracy. The term "chain" employed herein is meant to be a non-sliding wrapping transmission means covering endless chains and belts which can be rotated in engagement with rotating member such as gears. The apparatus of the present invention is applicable to any articles to be printed, provided that their regions to be printed are tapered and have circular section. Therefore, it should be construed that the application of the present invention is not limited to generally tapered articles having circular cross-section.

Besides the above-mentioned first and second arrangements incorporating the essential features of the present invention, the multicolour printing apparatus comprises a plurality of rotary printing units, a feeding unit for supplying articles to be printed and a delivery unit for delivering printed articles. In the apparatus of the present invention, all the rotating means of (A) constant-speed conveyor unit, (B) cradle rotating units, (C) rotary printing units, (D) feeding unit for supplying articles to be printed and (E) delivery unit for delivering printed articles are arranged to rotate in synchronism so that the articles to be printed can be continuously supplied and conveyed at a constant speed thereby enabling the tapered surfaces of the articles to be printed stepwise in multicolour with high accuracy and printed articles to be continuously delivered therefrom.

Figure 4:
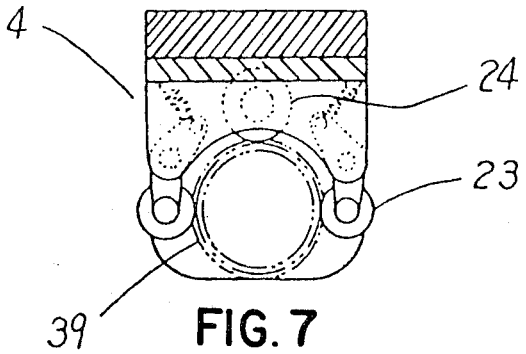
FIG. 4 is a fragmentary sectional plan view showing the condition of an article to be printed which is secured by means of the support means.

Next, the multicolour printing apparatus of the present invention and the operation thereof will be described below with reference to the accompanying drawings. FIG. 1 is an overall plan view of a multicolour printing apparatus incorporating a feeding unit for for supplying articles to be printed, a delivery unit for for sending out printed articles and rotary printing units. Articles to be printed are arranged to be supplied to the constant-speed conveyor unit set forth in (A) by means of a feed screw 14 and a star wheel 15. Printed articles are arranged to be delivered by the action of a star wheel 16 and a delivery belt 17. FIG. 2 is an explanatory view of the units described in (A) and (B) above. FIG. 3 is a fragmentary sectional view showing support means for supporting an article to be printed and a rotating means of a cradle. Articles to be printed are arranged to be sent in turn into the article support means 4. During the supply and delivery of articles to be printed, the cradle 12 is not allowed to rotate because the fixed chain 9 is arranged out to extend only in the region where articles to be printed are fed into the apparatus and printed articles are delivered therefrom. Also, an article retainer 21 is lifted by upward movement of a guide rod 20 which is caused by a caster 18 and a cam 19 which are engaged with each other. Therefore, the article to be printed can be smoothly sent into the article support means 4. After the article has been sent into the support unit 4, it is clamped transversely by a pair of clamp rollers 23 of the support means 4 and is supported on its back by a support roller 24 so that the centre of rotation of the article can be set. FIG. 4 is a plan view showing an article to be printed which is clamped in position by the clamp rollers 23 and the support roller 24.

After the article to be printed has been sent into the support means, the caster 18 will be disengaged from the cam 19 to allow the retainer 21 to depress the top of the article, while the cradle rotating sprocket 10 will begin to mesh with the fixed chain 9 thereby allowing the cradle 12 to begin its rotation. Meanwhile, the articles to be printed, which are held, respectively, by the retainer 21, the cradle 12, the clamp roller 23 and the support roller 24 and which are allowed to turn about the same centre of rotation, can be rotated at a constant speed in rolling contact with the transfer drums 29 so that the tapered outer peripheral surfaces of the articles can be printed stepwise in multicolour. After the completion of printing, the operation for sending out the printed articles from the support means 4 is made in accordance with the procedure reverse to the aforementioned feeding operation. In the support means 4, reference numeral 7 denotes an arm slidably fitted in the rotating shaft 6, 25 a cam, 26 a cam roller, and 27 a tension spring for the support means 4. The tension spring 27 is adapted to always pull the support means 4 towards the rotating shaft 11 of the rotary disk 1 so as to ensure the engagement of the cradle rotating sprocket 10 with the fixed chain 9. In order to achieve smooth engagement of the sprocket 10 with the chain 9 without any vibration, the cam 25 and the cam roller 26 are provided. Reference numeral 28 denotes a cam securing plate.

Figure 7:
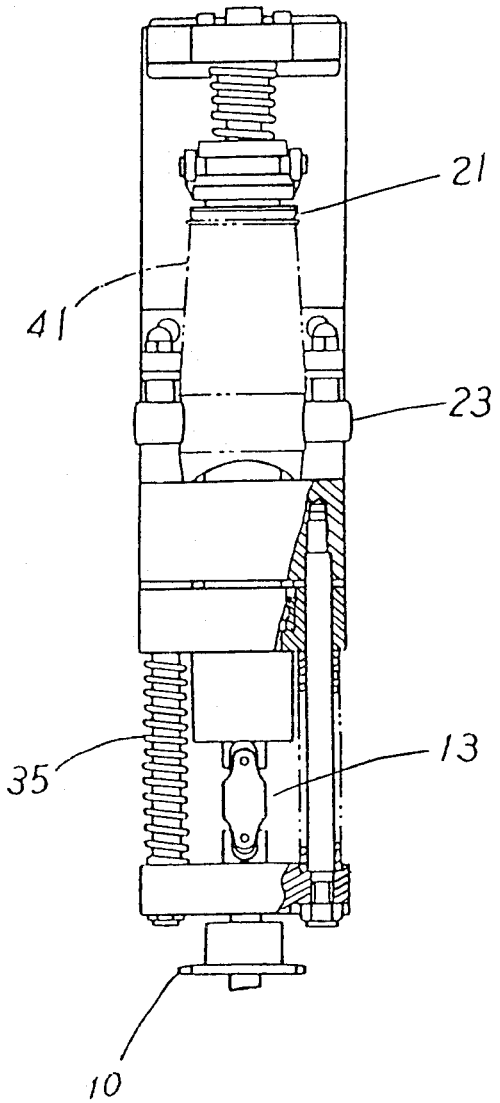
FIGS. 5 to 7 are fragmentary sectional elevational views for explaining cradle rotating unit and support means for supporting an article to be printed for use in the multicolour printing apparatus according to other embodiments of the present invention wherein the cradle comprises a vertically movable member and an outer ring member.
Figure 5:
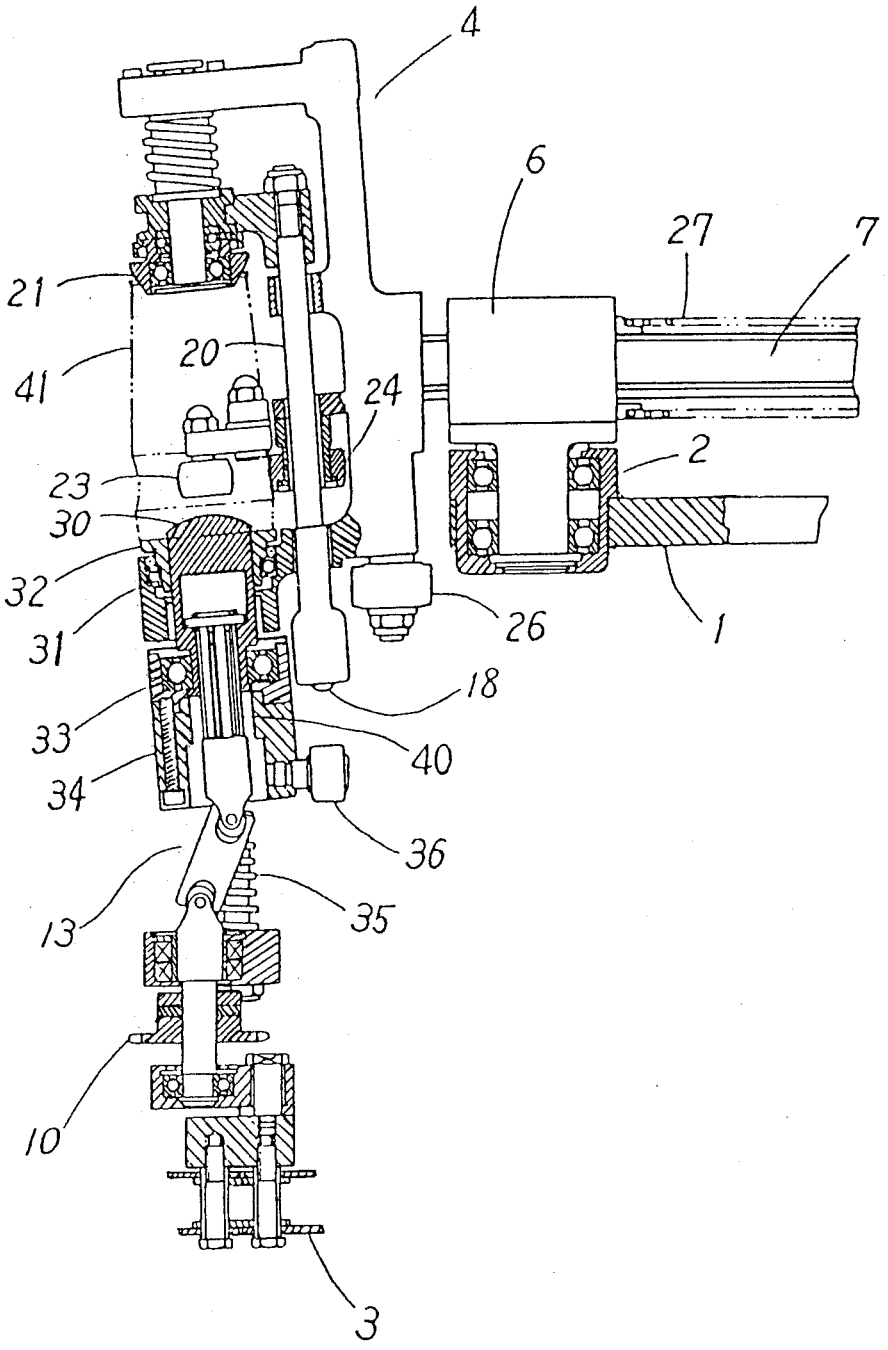
Figure 6:
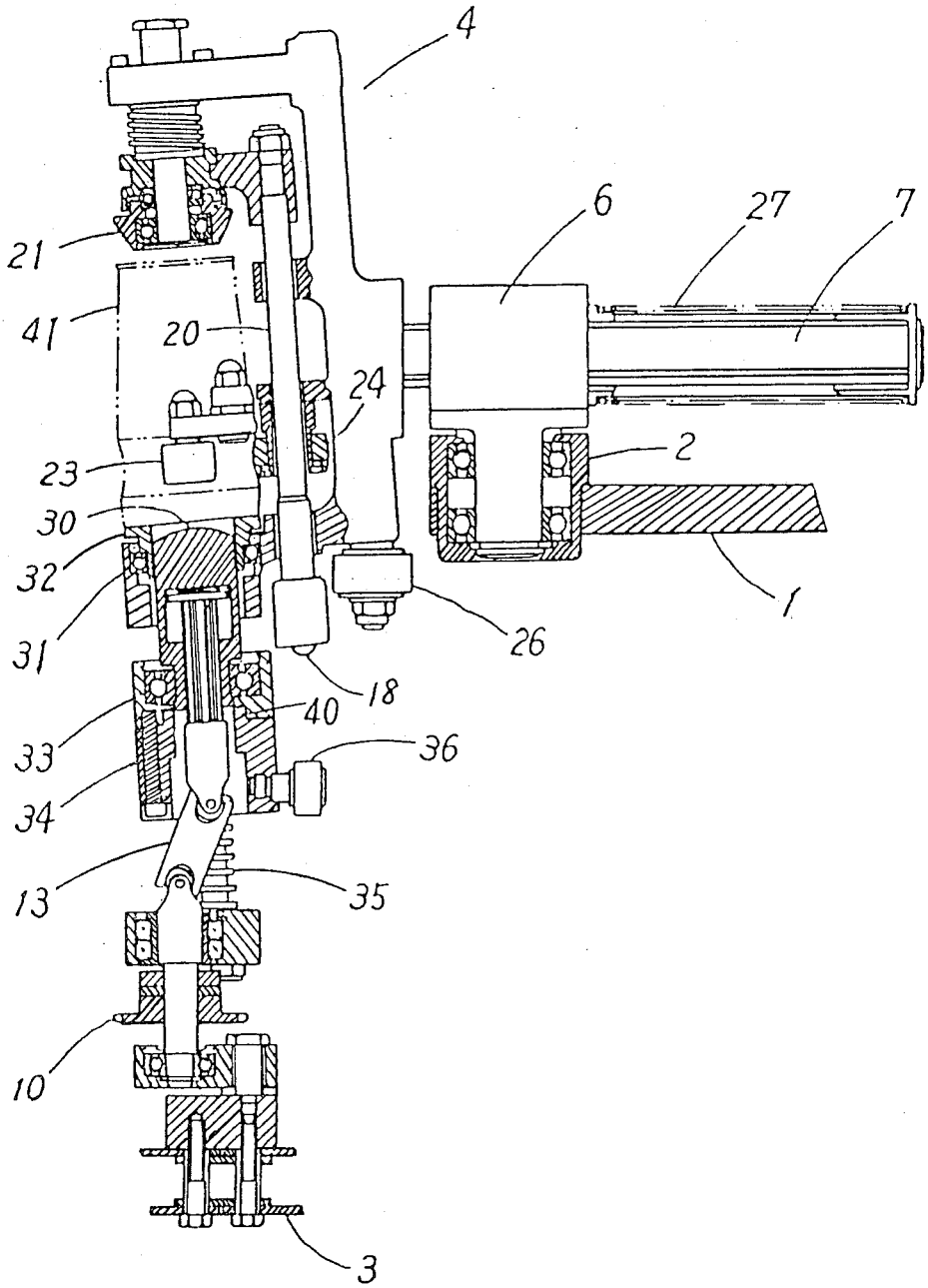
Figure 8:
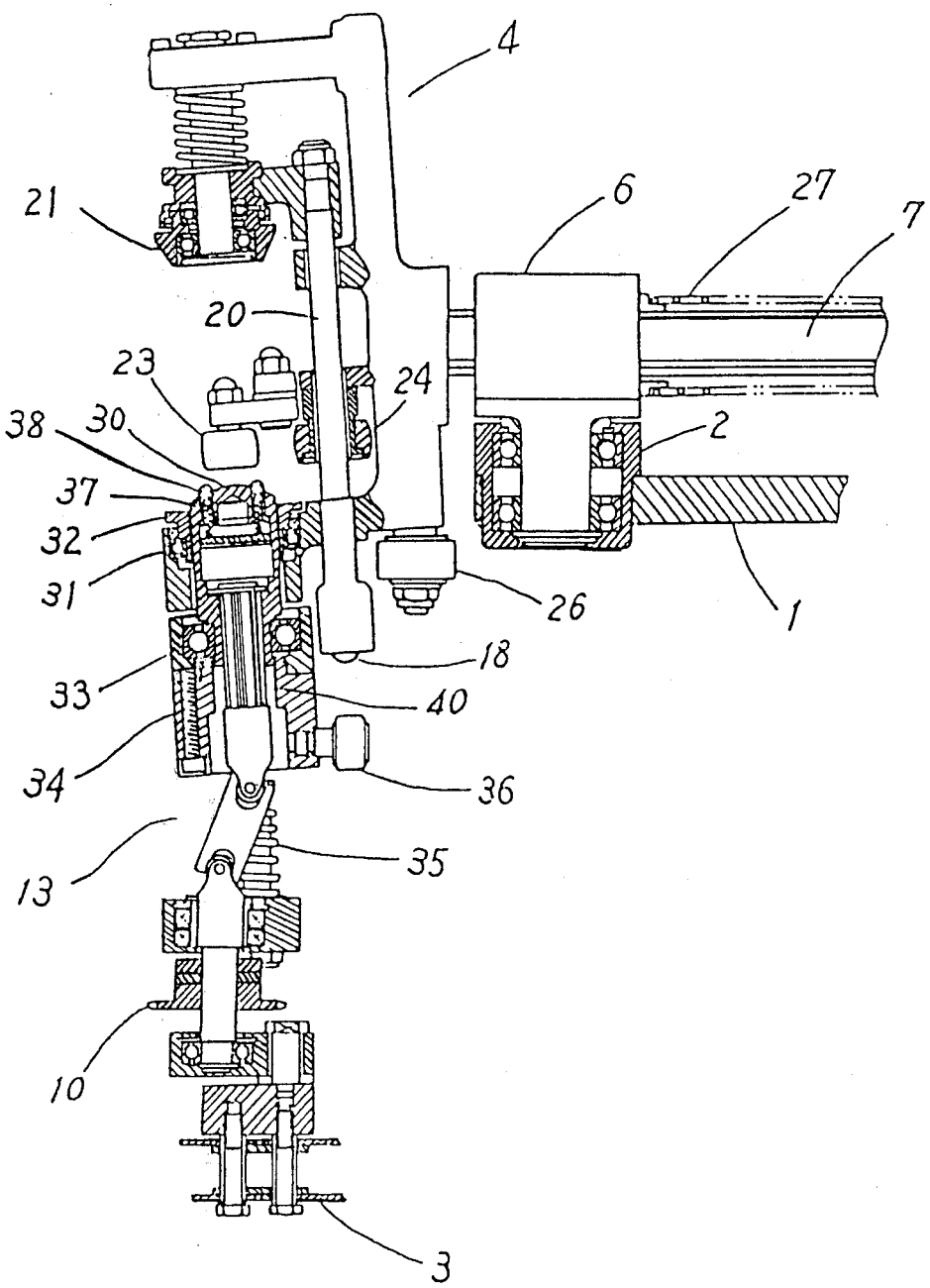
FIG. 8 is a fragmentary sectional view of a cradle rotating unit and support means for supporting an article to be printed employed in the multicolour printing apparatus according to a further embodiment of the present invention wherein the vertically movable member is provided with protruding members.

FIGS. 5 to 7 illustrate other embodiments of the cradle 12 of the article support means 4. Any of the cradles 12 shown therein comprises a vertically movable central member 30 to which the rotation of the sprocket 10 is transmitted and an outer ring member 32 adapted to be mounted through a bearing 32 on the frame of the support means 4 in such a manner as to rotate freely. All of FIGS. 5 to 7 are fragmentary sectional views. The abovementioned vertically movable central member 30 is connected through a bearing 33 with a vertically movable cylinder 34 having a cam roller 36 fitted thereto. The central member 30 has formed therein a spline bearing which is engageable with a spline shaft 40 adapted to transmit the rotation of the cradle rotating sprocket 10 through the universal joint 15. The vertically movable cylinder 34 is biased upwards by the resilient force of a spring 35. By such arrangement, a container 41 to be printed, for example, can be smoothly sent into or sent out from the article support unit 4 by lowering the central member 30 while the latter is being rotated, i.e., the fixed chain 9 is kept stretching around the outer peripheral surface of the fixed plate 8. A cam plate (not shown) is secured to the lower surface of the cam securing plate 28. Referring to FIG. 6 sending the container into or out from the support means, while the vertically movable cylinder 34 is depressed by the action of the cam roller 36 engaged with the cam plate, will lower the central member 30 which is connected through the bearing 33 with the cylinder 34. When the cam roller 36 is disengaged for the cam plate (not shown) with the turning movement of the support means 4, the cylinder 34 is pushed upwards by the resilient force of the return spring 35 thereby lifting the central member 30 (Refer to FIG. 5). FIG. 7 is a fragmentary sectional view of the container 41 and the cradle under the condition shown in FIG. 5. FIG. 8 shows one embodiment of the vertically movable central member 30 having protruding members 38 fitted to the surface thereof which can be kept into contact with the article to be printed, the protruding members 38 being biased upwards by the force of a spring 37. The vertically movable central member 30 can be brought into contact with the bottom of the article to be printed while the member 30 is being rotated and moved upwards. In this case, by forming recesses in the bottom of the article in which the protruding members 38 can be inserted, the article can be fixedly secured to the central member 30 thereby to prevent the occurrence of any blur in the images formed on the surfaces of the articles.

The protruding members 38 are biased by the force of the spring 37 and are therefore kept retracted when they are brought into contact with parts of the article other than the recesses and are allowed to project by the resilient force of the spring 37 when they are inserted in the recesses. Thus, the protruding members 38 can be smoothly fitted into the recesses of the article being printed.

Articles to be printed by the printing apparatus of the present invention include, for example, containers such as bottles, cans and cups etc., toys, sport goods, dolls, ornamental goods or the like which have tapered shape and circular cross-section in the regions thereof to be printed.

As described in detail hereinabove, according to the continuous multicolour printing apparatus of the present invention, clear multicolour images can be formed stepwise on the tapered surfaces of articles having circular cross-sections in the regions thereof to be printed. Furthermore, the aforementioned conveying locus can be set in any desired form, and so not only the number of the rotary printing units can be set as desired, but also in the cases where articles to be printed are containers, replacing some of the rotary printing units with charging unit(s), capper(s) and sealer(s) permits the performance of charging, capping, sealing and printing procedures by a continuous single operation in a limited amount of space.

What is claimed is:

1. A continuous multicolour printing apparatus for printing stepwise in multicolor the tapered surfaces of conical or truncated-conical articles which are successively fed and conveyed at a constant speed, the apparatus comprising:

(A) a conveyor unit adapted to convey articles to be printed at a constant speed which includes a rotary disc having a plurality of bearings mounted on the outer periphery thereof, a first rotating shaft for rotating the disc, a conveyor chain arranged to be moved along a predeterminned conveying locus or path, a second rotating shaft located within a first sprocket means driven by a prime mover and adapted to drive said conveying chain, a plurality of tilting support means each adapted to support an article to be printed, a plurality of third freely rotating support shafts each mounted in one of said bearings, said tilting support means each having an arm adapted to be slidably fitted into one of said third rotatable shafts, said tilting support means each being inclined by an angle corresponding to the degree of taper of the articles to be printed, a cradle for receiving said articles to be printed and having a fourth rotatable shaft, a power transmission shaft flexibly connected to said fourth rotatable shaft, said first rotating shaft of the rotary disc being arranged to rotate in synchronism with the rotation of said second rotating shaft and said first sprocket means;

(B) cradle rotating units each including a fixed plate having a similar configuration to said predetermined conveying locus, a fixed chain stretching around a major part of the outer periphery of said fixed plate, a second sprocket means arranged to rotate said cradle and meshing with said fixed chain so as to be rotated therealong thereby rotating said power transmission shaft of said second sprocket means rotating said power transmission shaft of said second sprocket means and said fourth rotatable shaft of said cradle connected to said power transmission shaft;

(C) a plurality of rotary printing means disposed along the conveying locus or path of the articles to be printed;

(D) a feeding unit for supplying articles to be printed to said conveyor unit; and (E) a delivery unit for delivering printed articles from the appartus, and that all the rotating means of said units set forth in (A) to (E) above are arranged to rotate in synchronism with one another.

2. A continuous multicolour printing apparatus as in claim 1 wherein said cradle rotating second sprocket means has a diameter which is equal to the average diameter of a circular cross-section of the tapered article to be printed, and the center of said circular cross-section is located on the extension line of the axis of rotation of the second sprocket means.

3. A continuous multicolour apparatus as in claim 1 or 2, wherein said cradle comprises a vertically movable central member and an outer ring member, said ring member being rotatably mounted through a first central bearing on the frame of the tilting support means, said vertically movable central member being connected through a second central bearing with a vertically movable cylinder having a cam roller mounted thereon, said central member having a spline bearing formed therein which is engageable with a spline shaft, said spline shaft adapted to transmit the rotation of the cradle rotating second sprocket means through the flexible connection to the central member and a return spring connected to said vertically movable cylinder whereby said vertically movable cylinder is biased upwards.

4. A continuous multicolour printing apparatus as in claim 3, wherein said vertically movable central member has protruding members mounted on the upper surface thereof which can be brought into contact with an article to be printed.

* * * * *